US005613324A

United States Patent [19]

Theune

[11] Patent Number: 5,613,324

[45] Date of Patent: Mar. 25, 1997

[54] PREFABRICATED DOOR FRAME

[75] Inventor: Robert J. Theune, Dothan, Ala.

[73] Assignee: Dunbarton Corporation, Dothan, Ala.

[21] Appl. No.: 529,051

[22] Filed: Sep. 15, 1995

[51] Int. Cl.[6] ..... E06B 3/32

[52] U.S. Cl. ..... 49/380; 49/67; 49/504; 49/506

[58] Field of Search ..... 49/380, 67, 61, 49/504, 506; 52/210–213

[56] References Cited

U.S. PATENT DOCUMENTS

| | | | |
|---|---|---|---|
| 3,044,130 | 7/1962 | Mehaffy | 49/67 |
| 3,298,135 | 1/1967 | Kinser | 49/380 |
| 3,345,780 | 10/1967 | McGhee | 49/504 |
| 4,001,972 | 1/1977 | Hurwitz | 49/380 |
| 4,115,968 | 9/1978 | Majumdar | 49/504 |
| 4,660,338 | 4/1987 | Wagner | 49/504 X |
| 4,813,204 | 3/1989 | Rentschler | 52/217 |
| 4,831,779 | 5/1989 | Kehrli et al. | 49/380 X |
| 4,930,257 | 6/1990 | Windgassen | 49/504 |
| 5,293,723 | 3/1994 | Slessor | 49/380 X |
| 5,392,565 | 2/1995 | Rentschler | 49/504 |

OTHER PUBLICATIONS

Rediframe Prefinished Steel Door Frame Products Brochure RPD–101 Rev. May 1995.

*Primary Examiner*—Philip C. Kannan
*Attorney, Agent, or Firm*—Jones & Askew

[57] ABSTRACT

A door frame and a method for constructing a door frame assembly for use in prefabricated housing. The door frame assembly has a header frame and two side frames fixedly attached and constructed out of metal. The door frame assembly is slidable into position in a prefabricated housing unit. The individual frame members are preferably manufactured from galvanized steel.

18 Claims, 4 Drawing Sheets

PREFABRICATED DOOR FRAME

TECHNICAL FIELD

This invention relates generally to door frames and more particularly to prefabricated door frame assemblies for installation and use in prefabricated housing.

BACKGROUND OF THE INVENTION

The various components in a prefabricated housing unit are often assembled in various locations and then shipped to the prefabricated housing manufacturer for installation into the housing unit. The housing manufacturer generally assembles these components in assembly line fashion. As with any product manufactured on an assembly line, time and ease of construction are paramount considerations.

The installed components in the construction of a prefabricated housing unit include the doors and the door frames. The door or frame manufacturer generally will construct the frame, hang the doors on the frame, and then the ship the door frame assembly to the prefabricated housing manufacturer for installation therein.

An example of current door frame assembly design is shown in FIG. 1. In essence, the construction of this prefabricated door frame assembly 10 starts with the assembly of a wooden frame 20. An exterior aluminum frame 30 with one or more hinges 35 and a door stop 37 is attached to the wooden frame 20 and an aluminum screen door 40 is then attached to the hinges 35. One or more entry door hinges 50 and an entry door stop 55 are attached to the opposite side of the wooden frame 20. A steel entry door 60 is then attached to the entry door hinges 50. Weather stripping 65 is also applied. The unit 10 is then shipped to a housing manufacturer. The manufacturer slides and fastens the door frame assembly 10 into place in the prefabricated unit.

Although this method provides a door and door frame that can be easily installed into a prefabricated housing unit, there are drawbacks in terms of strength, security, and costs. The housing unit is only as strong and secure as the wooden frame upon which the doors are hung. Further, the method of construction for the frame manufacturer is expensive and time consuming given the number of parts involved. Several laborers are required to construct this type of door frame assembly.

Although it is known in the art of residential and commercial construction to use steel door frames for increased strength and security, such frames have not been used in the prefabricated housing industry because of difficulties in installation. These frames generally comprise several discrete components that are assembled at the construction site. For example, the assignee of the present application manufactures and sells a steel frame under the trademark "Rediframe" brand wall system. This product envelopes and is attached to the surrounding wall. As is shown in FIG. 2, the door frame assembly 70 comprises a header frame 75 and two side frames 80. Each frame member 75, 80 of the door frame assembly 70 surrounds the wall 86 and is held in place by a plurality of fasteners 90 which penetrate wall board 85 and engage the wall framing such as steel stud 95. The door frame assembly 70 is thus secured to the wall framing, such as steel stud 95, positioned behind the wall board 85. The doors are then hung after the frame unit 70 is in place in the wall 86.

Although a steel door frame would provide additional security, this type of construction is not suited for the prefabricated housing industry because of the time involved in attaching each of the respective frame members to the wall and then mounting the doors. In other words, this type of door frame is not appropriate for the prefabricated housing industry because known steel door frames cannot be adapted for installation in assembly line fashion. The industry demands that the door frame assembly be able to slide quickly into place in the housing unit with both doors pre-hung.

What is needed therefore, is a door frame assembly of simple manufacture for use in the prefabricated housing industry. The door frame assembly should provide superior strength and security while being easy to assemble with reasonable costs. It is essential that the door frame assembly be able to slide into place into a prefabricated housing unit as the unit is progressing on the assembly line.

SUMMARY OF THE INVENTION

The present invention provides a door frame, door frame assembly, and a method for constructing a door frame assembly for use in prefabricated housing. The door frame assembly has a header frame and two side frames fixedly attached and constructed out of metal. The door frame assembly is slidable into position in a prefabricated housing unit. The individual door frame members are preferably manufactured from galvanized steel, and each has an extended door stop, one or more kerfs, an extended lip, and one or more substrate retaining members formed integrally therein. In one embodiment of the present invention the lip of the frame member may be a separate piece.

A substrate formed of wood, plastic, or other suitable material is positioned inside the side frame members of the side frames. The substrate serves to reinforce the door frame members and to retain screws or other fasteners used with the door hardware. Weather stripping is positioned in each of the kerfs of the side frames. The extended lip has a plurality of recesses for receiving fasteners. A storm door and an entry door are then rotatably attached to one of the door frame.

The completed door frame assembly is then shipped to a prefabricated housing manufacturer for installation into a prefabficated housing unit. The door frame assembly is slid into place in the doorway and is attached by nails or other fasteners inserted through the recesses in the extended lip.

It is thus an object of the present invention to provide an improved door frame and door frame assembly for prefabricated housing.

It is another object of the present invention to provide a door frame and door frame assembly that can be easily slid into place in prefabricated housing.

It is a still further object of the present invention to provide a door frame and door frame assembly that provide superior security.

It is a still further object of the present invention to provide a steel door frame for use in prefabricated housing.

It is a still further object of the present invention to provide a door frame and door frame assembly that are reasonably priced.

It is a still further object of the present invention to provide a door frame and door frame assembly that are easy to manufacture.

It is a still further object of the present invention to provide a door frame and door frame assembly that can accommodate varying sizes of prefabricated housing and variances in construction specifications.

Other objects, features, and advantages of the present invention will become apparent upon review of the following detailed description of the preferred embodiments of the invention, when taken in conjunction with the drawings and the claims.

DETAILED DESCRIPTION OF THE INVENTION

Figure 1:
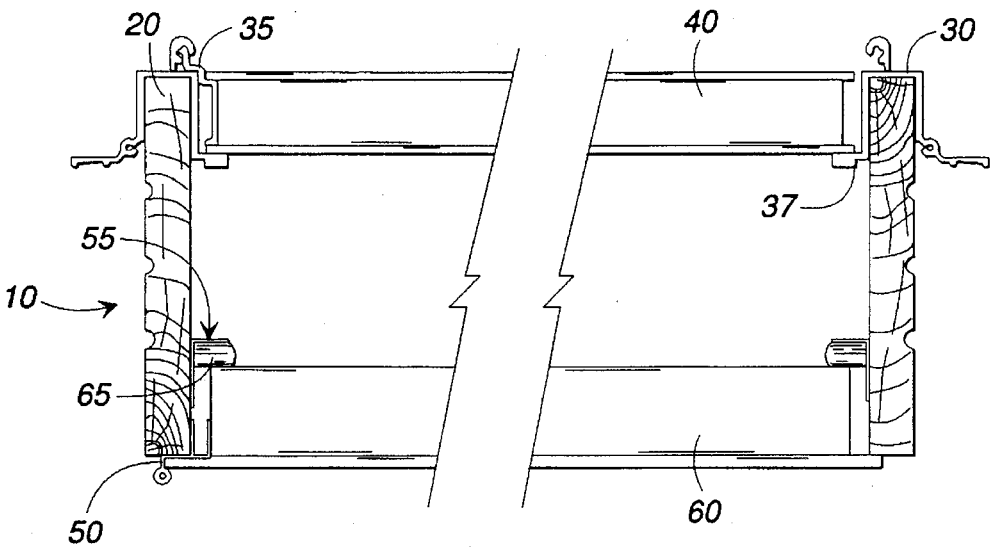
(PRIOR ART) FIG. 1
FIG. 1 is a cross-sectional view of a prior art prefabricated housing door frame and door frame assembly.
Figure 2:
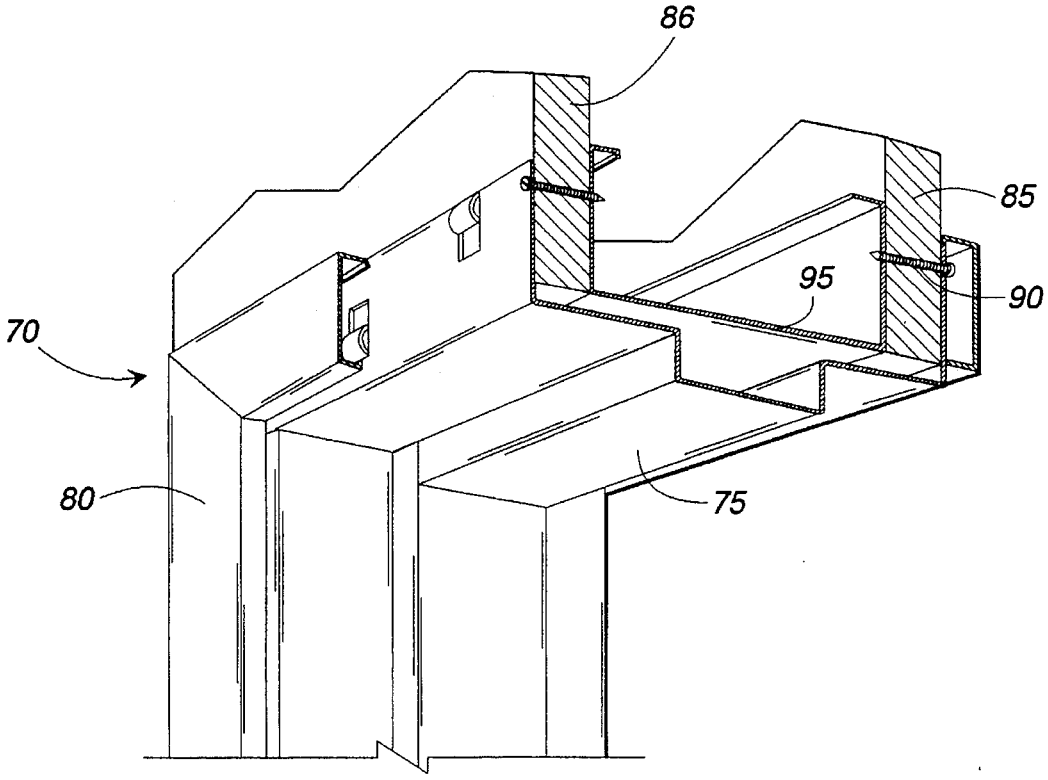
(PRIOR ART) FIG. 2
FIG. 2 is a perspective view of a prior art steel door frame.
Figure 3:
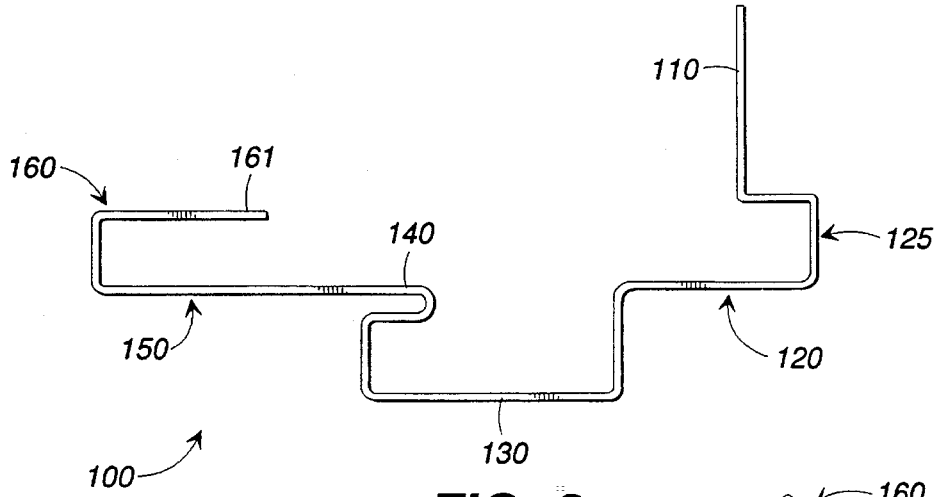
FIG. 3 is a cross-sectional view of a door frame in accordance with the present invention.
Figure 4:
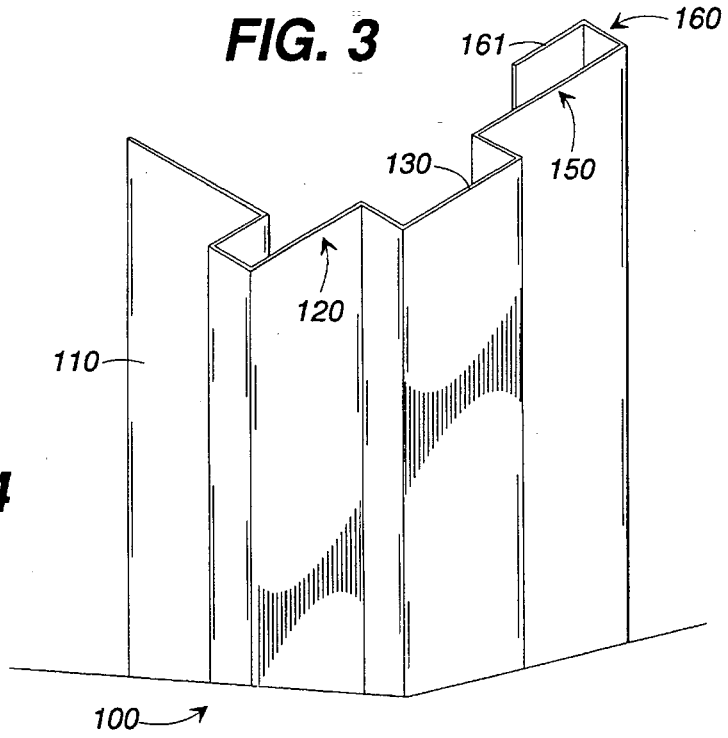
FIG. 4 is a perspective view of an alternative door frame in accordance with the present invention.

Referring now to the drawings in which like numerals represent like parts throughout the several views, FIGS. 3–6 show one preferred embodiment of the door frame 100 and a door frame assembly 200. As is shown in FIG. 3, the door frame 100 has an extended lip 110, a storm door side rabbet 120, a storm door side, u-shaped substrate retaining member 125, an extended door stop 130, a kerf 140, an entry door side rabbet 150, and an entry door side, u-shaped substrate retaining member 160 with a flange 161 formed integrally therein. FIG. 4 shows a perspective view of a similar embodiment of the frame 100 without the kerf 140.

The door frame 100 is preferably a uniform piece of steel such as 24 gauge steel. The steel is preferably galvanized or otherwise rust resistant. The methods of forming the metal for the frame 100 are known in the art and include cold rolling. Other types of material that can be used for the door frame 100 include 16, 18, 20, or 22 gauge steel or even stainless steel. All bends in the door frame 100 are approximately 90 degrees.

The preferred dimensions of the door frame 100 include a width, from the storm door side rabbet 120 to the entry door side rabbet 150, of approximately 4 3/16 inches. This includes a width of the storm door side rabbet 120 of approximately 1 1/8 inches, the door stop 130 of approximately 1 1/2 inches, and the entry door side rabbet 150 of approximately 1 9/16 inches. The storm door side substrate retaining member 125 extends from the storm door side rabbet 120 approximately 5/8 inch, and then the extended lip 110 extends approximately another one inch. The door stop 130 preferably extends from the storm door side rabbet 120 and the entry door side rabbet 150 by approximately 5/8 inch. The kerf 140 is approximately 3/8 inch in width and extends approximately 1/8 inch from the entry door side rabbet 150. The entry door side substrate retaining member 160 extends approximately 5/8 inch from the entry door side rabbet 150 with an extended flange 161 of approximately one inch in width.

Figure 6:
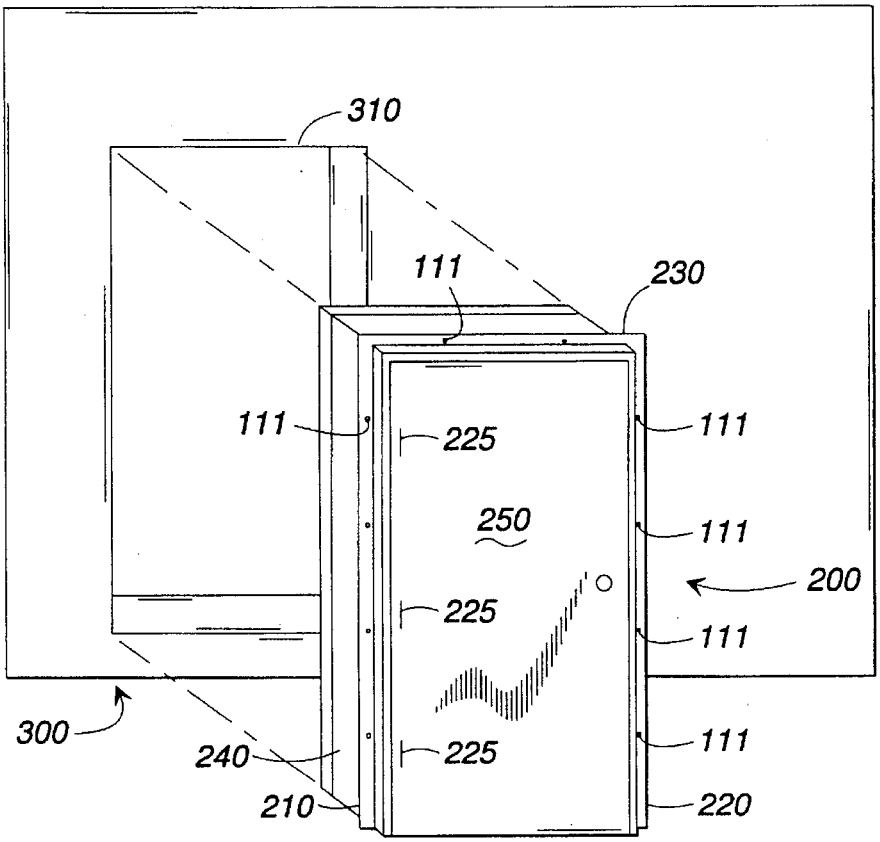
FIG. 6 is a perspective view showing the installation of the door frame assembly of FIG. 5 into place in a prefabricated housing unit.

These dimensions are for use in a prefabricated housing unit 300 (FIG. 6). Such prefabricated housing 300 generally has a doorway 310 with a wall thickness of approximately four to six inches. All of the dimensions of the door frame 100 can vary according to the thickness of the doorway 310 or according to the size of the doors to be used with the door frame 100. Further, the extended flange 161 permits use of the same frame 100 with housing units 300 having varying or inconsistent wall thicknesses. Because the extended flange 161 is preferably one inch in length, the frame 100 can accommodate doorway 310 thicknesses that vary from the standard four to six inches by approximately the same one inch.

Figure 5:
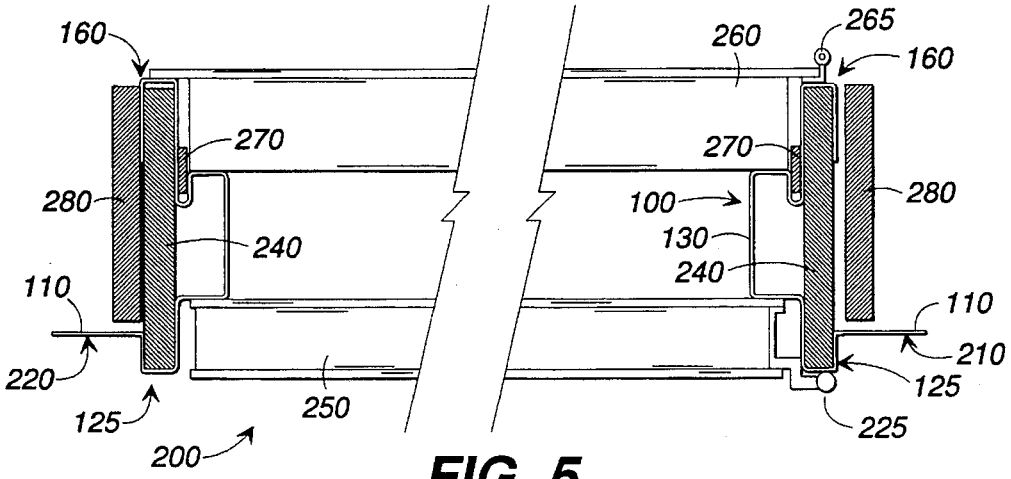
FIG. 5 is a cross-sectional view of a door frame assembly incorporating the door frame of FIG. 3.

FIGS. 5 and 6 show a door frame assembly 200. The door frame assembly 200 comprises three door frames 100, including a hinge frame or jamb 210, a strike frame or jamb 220, and a header frame or jamb 230. The header frame 230 is positioned on the top of the frame assembly 200, and the hinge frame 210 and the strike frame 220 are positioned perpendicularly underneath on either end thereof. The hinge frame 210, the strike frame 220, and the header frame 230 are joined via slot and tab assembly or other conventional fastening methods. A typical frame assembly 200 has a hinge frame 210 and a strike frame 220 of approximately from six feet and six inches to six feet and eight inches in length and a header frame of approximately from two feet and six inches to three feet in width. The length of the frame members 100 can vary according to the length and width of the doorway 310.

With reference to FIG. 6, the extended lip 110 of each frame member 100 has a plurality of recesses 111 therein. The recesses 111 are preferably sized to accommodate 1/8 inch nails. The hinge frames 210 and the strike frames 220 preferably have four recesses 111 spaced thereon, and the header frame 230 preferably has two recesses thereon. Any conventional number of recesses 111, however, may be used.

Returning to FIG. 5, the door frame assembly 200 includes door frames 100, a substrate 240 positioned within each side frame 100, a storm door 250, a plurality of storm door hinges 225, an entry door 260, and a plurality of entry door hinges 265. The storm door 250 can be any type of conventional door, such as an aluminum door with either glass or screen windows. The entry door 260 is preferably made of steel or other type of material with sufficient strength to provide a secure barrier. The hinges 225, 265 are of conventional manufacture. The door frame assembly 200 further comprises weather stripping 270 within kerf 140. Any conventional type of weather stripping may be used.

In constructing the door frame assembly 200, the substrate 240 is inserted into the substrate retaining members 125, 160 of side frame members 100. The substrate 240, which may be composed of wood, plastic, or other suitable materials, is held in place by friction within each side frame member 100. In one embodiment, the substrate 240 is wood and is slightly less than 5/8 inch thick, slightly less than 4 3/16 inches wide. The dimensions of the substrate 240 can vary according to the dimensions of the side frame members 100. The substrate 240 can extend the full length of the side frame members 100, or the substrate can be divided into discrete sections located at the six hinge locations or other hardware mounting points along the length of the side frame members 100. The substrate 240 serves to stiffen the side frame members 100 and to hold the screws for the hinges, strikes, deadbolt, and other door hardware.

The storm door 250 is positioned on the storm door side rabbet 120 of each frame member 100. The storm door 250 is attached to the hinge frame 210 by three storm door hinges 225. The hinges 225 are attached to the storm door 250 and to the hinge frame 210 by bolts, screws or other conventional means. Although three storm door hinges 225 are preferred, any conventional number may be used.

Similarly, the entry door 260 is positioned on the entry door side rabbet 150 of each frame member 100. The entry door 260 is attached to the hinge frame 210 by three entry door hinges 265. The hinges 265 are attached to the entry door 260 and to the hinge frame 210 by bolts, screws or other conventional means. Although three entry door hinges 265 are preferred, any conventional number may be used.

Weather stripping 270 is inserted into each kerf 140 of each frame member 100. The weather stripping 270 is maintained in place via a friction fit. A spacer plank 280 may be placed on the outside of the hinge frame 210, the strike frame 220, and the header frame 230. The door frame assembly 200 is then complete.

The door frame assembly 200 is then shipped to the prefabricated housing manufacture for installation. The prefabricated housing manufacturer simply slides the door frame assembly 200 into the doorway 310 of a prefabricated housing unit 300. The door frame assembly 200 is then secured into place via nails or other conventional fasteners inserted through the recesses 111. The door frame assembly 200 is now ready for use.

Figure 7:
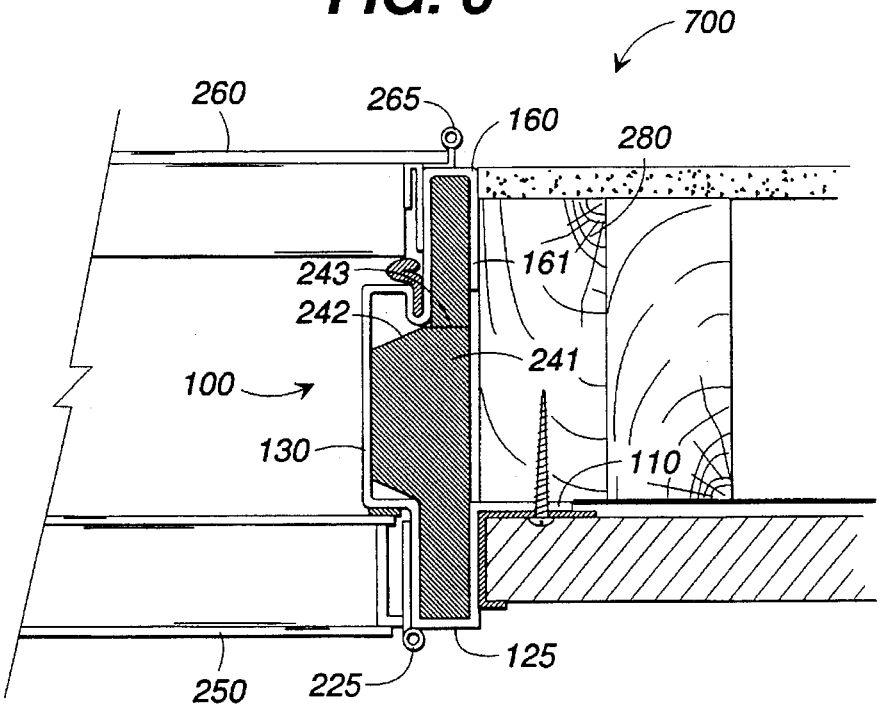
FIG. 7 is a cross-sectional view of an alternative door frame assembly incorporating the door frame shown in FIG. 3 with a plastic substrate within the door frame.

Another embodiment of the door frame assembly of present invention is shown in FIG. 7. The door frame assembly 700 in FIG. 7 is similar to the door frame assembly 200 in FIG. 5 except that the substrate 240 of door frame assembly 200 in FIG. 5 has been replaced by a molded plastic substrate 241 with an integral projection 242. The substrate 241 can extend the full length of the side frame members 100, or the substrate 241 can be divided into discrete sections located at the six hinge locations or other hardware mounting points along the length of the side frame members 100. The substrate 241 serves to stiffen the door frame members 100 and to hold the screws for the hinges, strikes, deadbolt, and other door hardware.

The projection 242 supports the door stop 130 and provides a means for securing a door check to door stop 130. Particularly, when a door check is fastened to door stop 130, a screw is driven through the door stop 130, through the projection 242, and into the spacer plank 280. The projection 242 assures that the screw does not bend the door stop 130 as the screw is tightened into the spacer plank 280.

The substrate 241 may also be molded as two pieces separated at line 243. Each substrate piece can be separately inserted into the frame 100 from the side without having to slide the substrate pieces into side frame members 100 from the ends. Once in place, the substrate pieces are held in place by friction, by the spacer plank 280, and by fasteners used with the door hardware.

Figure 8:
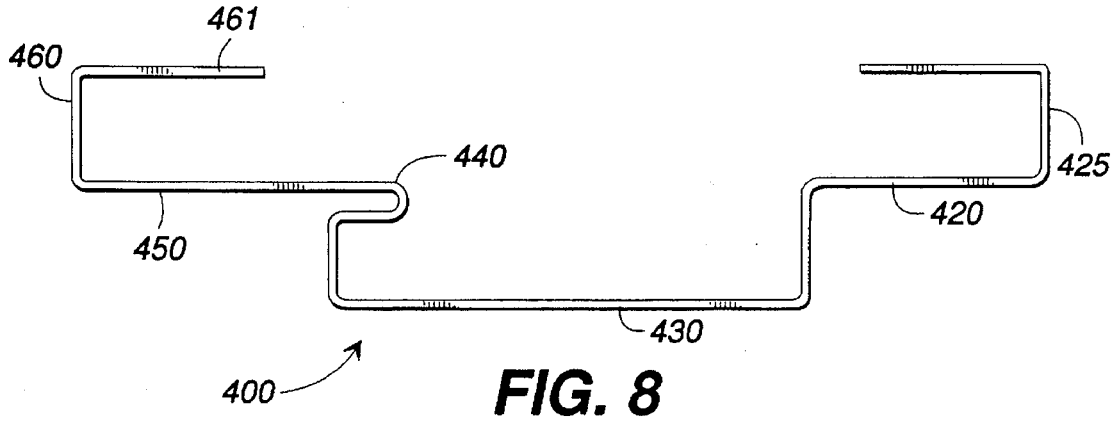
FIG. 8 is a cross-sectional view of an alternative door frame in accordance with present invention.
Figure 9:
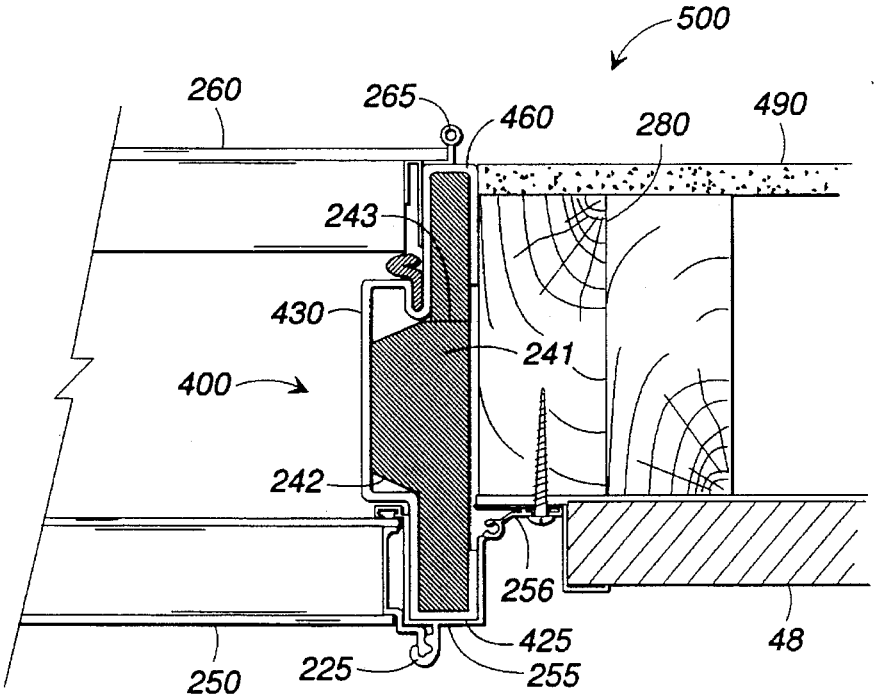
FIG. 9 is a cross-sectional view of a door frame assembly incorporating the door frame shown in FIG. 8 with the plastic substrate within the door frame.

Another embodiment of the present invention is a door frame 400 shown in FIG. 8 and 9. As shown in FIG. 8, the door frame 400 has a storm door side rabbet 420, a storm door side, u-shaped substrate retaining member 425, an extended door stop 430, a kerf 440, an entry door side rabbet 450, and an entry door side, u-shaped substrate retaining member 460 with a flange 461 formed integrally therein. FIG. 9 shows the door frame 400 incorporated into a door frame assembly 500 with a storm door 250, and entry door 260, a molded plastic substrate 241 and a spacer plank 280. The storm door side, u-shaped substrate retaining member 425 of the door frame 400 is engaged by each of the hinges 225 of the storm door 250. Each hinge 225 has u-shaped portion 255 and an extending lip 256. The u-shaped portion 255 engages the u-shaped substrate retaining member 425 of door frame 400 and is connected to the door frame 400 and substrate 241 by screws (not shown). The lip 256 of hinge 225 is fastened to the spacer plank 280 by screws or other fasteners.

The present invention is thus a significant improvement in the art because it provides door frames and door frame assemblies that are significantly stronger and safer than known frames for prefabricated housing units. Further, the present invention provides these improvements in the art at a much lower costs because significantly fewer components are used. By using door frame members of galvanized steel, as opposed to the wooden frame members found in the prior art, the present invention offers a significantly stronger door frame unit and, hence, greater security to the home owner. Similarly, known steel door frame assemblies simply required too much installation time to be practical in the prefabricated home industry. The present invention solves this problem through the use of a unitary structure that can be slid into place. Strength and cost improvements are also realized by using the molded plastic substrates with integral projection in place of a solid wood substrate.

Other inventive features of the present invention include the use of the extended lip 110. The extended lip 110 not only provides a means to secure the door frame assembly 200 to the prefabricated housing unit 300, but also permits the door frame assembly 200 to be used in doorways that are slightly out of square. This "rebated" door can therefore accommodate minor variations in manufacturing specifications. These variation can be expected in prefabricated housing industry and are overcome by the present invention.

The present invention is thus a significant improvement in the art of prefabricated door frames because the invention provides greater security with fewer components at lower costs. The invention provides a steel security door and frame to the prefabricated home owner while lowering the manufacturer's costs and construction time.

Although this invention has been described in specific detail with reference to the disclosed embodiment, it will be understood that many variations and modifications may be affected within the spirit and scope of the invention as described in the following claims.

I claim:

1. A door frame for a prefabricated house having a doorway with a front side and a rear side and defining a doorway opening therethrough, comprising:

a header frame;

two side frames each fixedly attached to said header frame to form said door frame and wherein each of said side frames is constructed of formed metal and comprises:

a storm door side u-shaped member; and an entry door side u-shaped member;

a lip extending outwardly from said storm door side u-shaped member of at least one of said side frames so that said door frame can be slid into the doorway opening until the sliding is arrested by said lip abutting the front side of the doorway in the prefabricated house; and a substrate inserted into each side frame and extending between said u-shaped members in each side frame to strengthen each side frame.

2. The door frame of claim 1, wherein said header frame is constructed of formed metal and comprises:

a storm door side u-shaped member;

an entry door side u-shaped member; and a lip extending outwardly from said storm door side u-shaped member and wherein a substrate is inserted into said header frame and extends between said u-shaped members in said header frame to strengthen said header frame.

3. The door frame of claim 2, wherein said header and side frames further comprise an extended door stop formed integrally therein.

4. The door frame of claim 3, wherein said substrate is molded plastic with an integral projection engaging said extended door stop.

5. The door frame of claim 2, wherein said header and side frames further comprise at least one kerf formed integrally therein.

6. The door frame of claim 2, wherein said lip of said header frame is integrally formed therein and said lip of said at least one of said side frames is integrally formed therein.

7. The door frame of claim 1, further comprising a storm door rotatably attached to one of said side frames.

8. The door frame of claim 1, further comprising an entry door rotatably attached to one of said side frames.

9. A method for constructing and installing a door frame in a prefabricated house having a doorway with a front side and a rear side and defining a doorway opening therethrough, comprising the steps of:

forming a plurality of frames from steel wherein each frame comprises:

a storm door side u-shaped member;

an entry door side u-shaped member; and a lip extending outwardly from the storm door side u-shaped member;

inserting a substrate into the frames wherein the substrate is sized to extend between the u-shaped members in each frame to strengthen each frame;

fixedly attaching three of the frames to define a header frame and two side frames;

hanging a door on one of the side frames; and sliding the door frame into the doorway opening until the sliding is arrested by the lip abutting a side of the doorway in the prefabricated house.

10. The method of claim 9, wherein the lip of the header and side frames is integrally formed therein.

11. The method of claim 9, wherein the header and side frames further comprise an extended door stop formed integrally therein.

12. The method of claim 11, wherein the substrate is molded plastic with an integral projection engaging the extended door stop.

13. A method for constructing and installing a door frame in a prefabricated house having a doorway with a front side and a rear side and defining a doorway opening therethrough, comprising the steps of:

forming a plurality of frames from steel wherein each frame comprises:

a front portion at least partially defining a front rabbet;

a rear portion at least partially defining a rear rabbet; and a door stop connected between the front portion and the rear portion;

fixedly attaching three of the frames to define a door frame including a header frame and two side frames;

incorporating an outwardly extending metal lip into the door frame; and sliding the door frame into the doorway opening until the sliding is arrested by the lip abutting one of the sides of the doorway.

14. The method of claim 13, wherein the installing step further includes the step of engaging fasteners between recesses defined in the lip and the doorway, subsequent to the moving step.

15. The method of claim 13, further comprising the step of hanging a first door on the front portion and a second door on the rear portion of one of the side frames prior to the sliding step.

16. The method of claim 13, wherein the incorporating step includes the step of rotatably attaching a door to one of the side frames with a plurality of hinges that define the lip.

17. The method of claim 13, wherein the method further comprises the step of inserting substrate into each side frame to strengthen each side frame prior to the sliding step, and wherein for each side frame the front portion is u-shaped and the rear portion is u-shaped, and the substrate extends between the front portion and the rear portion.

18. The method of claim 13, wherein the incorporating step is part of the forming step such that the lip is integral to at least one of the side frames.

* * * * *